US009939111B2

(12) United States Patent
Han et al.

(10) Patent No.: US 9,939,111 B2
(45) Date of Patent: Apr. 10, 2018

(54) AUXILIARY SECONDARY BARRIER, LIQUEFIED NATURAL GAS STORAGE TANK INCLUDING SAME AND METHOD FOR MANUFACTURING THE LIQUEFIED NATURAL GAS STORAGE TANK

(71) Applicant: SAMSUNG HEAVY IND. CO., LTD., Seoul (KR)

(72) Inventors: Sungjong Han, Seoul (KR); Minhong Kim, Geoje-si (KR); Jongho Kim, Geoje-si (KR)

(73) Assignee: SAMSUNG HEAVY IND. CO., LTD., Seoul (KR)

( * ) Notice: Subject to any disclaimer, the term of this patent is extended or adjusted under 35 U.S.C. 154(b) by 652 days.

(21) Appl. No.: 14/365,089

(22) PCT Filed: Oct. 11, 2012

(86) PCT No.: PCT/KR2012/008273
§ 371 (c)(1),
(2) Date: Jun. 12, 2014

(87) PCT Pub. No.: WO2013/089345
PCT Pub. Date: Jun. 20, 2013

(65) Prior Publication Data

US 2014/0331690 A1 Nov. 13, 2014

(30) Foreign Application Priority Data

Dec. 16, 2011 (KR) ..... 10-2011-0136453
Dec. 16, 2011 (KR) ..... 10-2011-0136725

(51) Int. Cl.
*F17C 3/08* (2006.01)
*F25D 23/06* (2006.01)
(Continued)

(52) U.S. Cl.
CPC ..... *F17C 13/001* (2013.01); *E04H 7/02* (2013.01); *F17C 3/027* (2013.01); *F17C 9/02* (2013.01);
(Continued)

(58) Field of Classification Search
CPC .. F17C 3/027; F17C 13/001; F17C 2201/052; F17C 2203/0358; F17C 2203/0631;
(Continued)

(56) References Cited

U.S. PATENT DOCUMENTS

2008/0011756 A1 1/2008 Lee
2011/0056955 A1* 3/2011 Joh ..... B63B 25/16 220/560.12

FOREIGN PATENT DOCUMENTS

FR 2903758 A1 1/2008
IE 2306065 A2 4/2011
(Continued)

OTHER PUBLICATIONS

Machine translation of Yasuda JP 2008-115260.*
(Continued)

*Primary Examiner* — Joseph Trpisovsky
(74) *Attorney, Agent, or Firm* — McDermott Will & Emery LLP

(57) ABSTRACT

An LN storage tank is disclosed. The LNG storage tank includes: a lower insulation board for insulating LNG from the outside; a heating member placed on the lower insulation board; a main secondary barrier attached on the heating member; an upper insulation board attached on part of the main secondary barrier; and an auxiliary secondary barrier attached on the other part of the main secondary barrier, wherein a first adhesive layer may be interposed between the main secondary barrier and the auxiliary secondary barrier.

9 Claims, 18 Drawing Sheets

(51) Int. Cl.

| | |
|---|---|
| ***F17C 13/00*** | (2006.01) |
| ***F17C 3/02*** | (2006.01) |
| ***F17C 9/02*** | (2006.01) |
| ***E04H 7/02*** | (2006.01) |
| *B63B 25/16* | (2006.01) |

(52) U.S. Cl.
CPC ..... *B63B 25/16* (2013.01); *F17C 2201/0157* (2013.01); *F17C 2201/052* (2013.01); *F17C 2203/03* (2013.01); *F17C 2203/0358* (2013.01); *F17C 2203/0626* (2013.01); *F17C 2203/0631* (2013.01); *F17C 2203/0651* (2013.01); *F17C 2221/033* (2013.01); *F17C 2223/0161* (2013.01); *F17C 2223/033* (2013.01); *F17C 2227/0304* (2013.01); *F17C 2227/0381* (2013.01); *F17C 2270/0107* (2013.01); *Y10T 29/49885* (2015.01)

(58) Field of Classification Search
CPC ..... F17C 2203/0651; F17C 2221/033; F17C 2223/0161; F17C 2223/033; F17C 2227/0304; F17C 2227/0381; F17C 2270/0107; F17C 2203/0626; F17C 2227/0369; F17C 2227/0376; B63B 25/16; B63B 3/68; Y10T 29/49885; F25B 21/02; F25B 21/04; F25B 2321/02; F25B 2321/023
USPC ..... 62/45.1, 451
See application file for complete search history.

(56) References Cited

FOREIGN PATENT DOCUMENTS

| | | | |
|---|---|---|---|
| JP | S 59-081373 | A | 5/1984 |
| JP | 2008-115260 | A | 5/2008 |
| JP | 2008-531941 | A | 8/2008 |
| KR | 10-0557354 | B1 | 2/2006 |
| KR | 100553017 | B1 | 2/2006 |
| KR | 100764124 | B1 | 9/2007 |
| KR | 1020090132534 | A | 12/2009 |
| KR | 1020100062047 | A | 6/2010 |
| KR | 1020110003038 | A | 1/2011 |
| KR | 1020110133268 | A | 12/2011 |
| WO | WO-2007/052961 | A1 | 5/2007 |

OTHER PUBLICATIONS

English language translation of International Preliminary Report on Patentability dated Jun. 19, 2014, which issued in International Application No. PCT/KR2012/008273, 8 pages.

* cited by examiner

[Fig. 1]
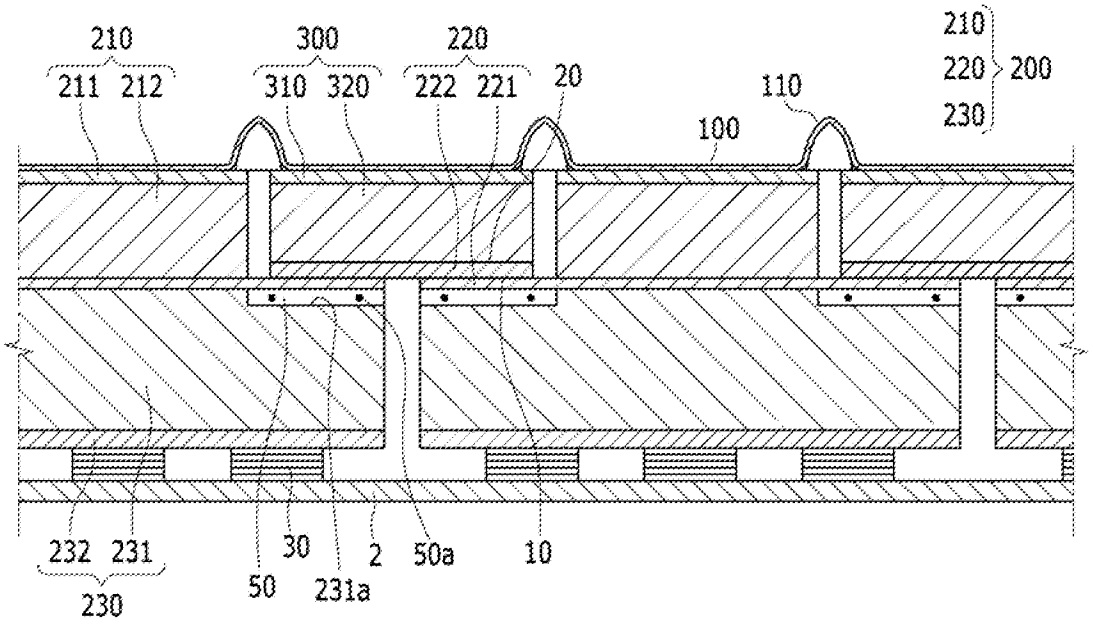

[Fig. 2]
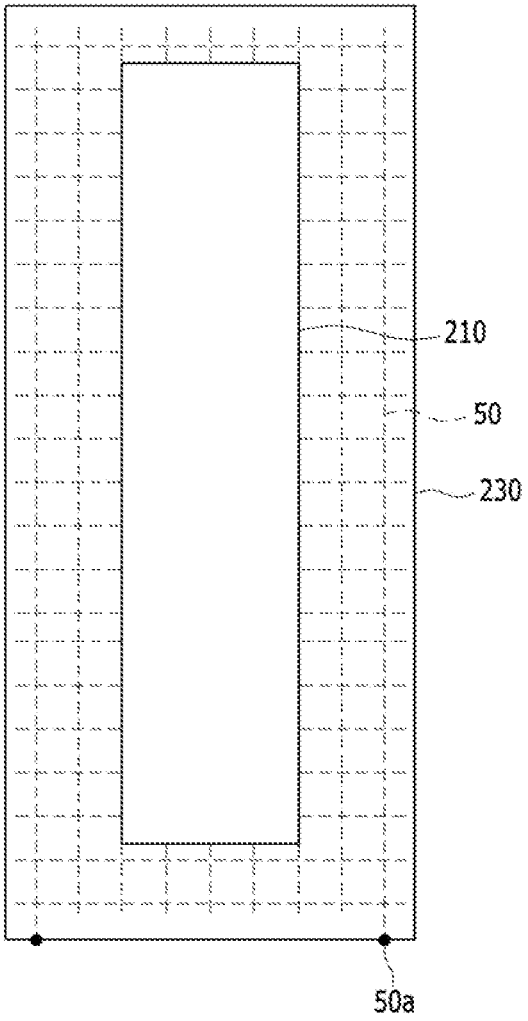

[Fig. 3]
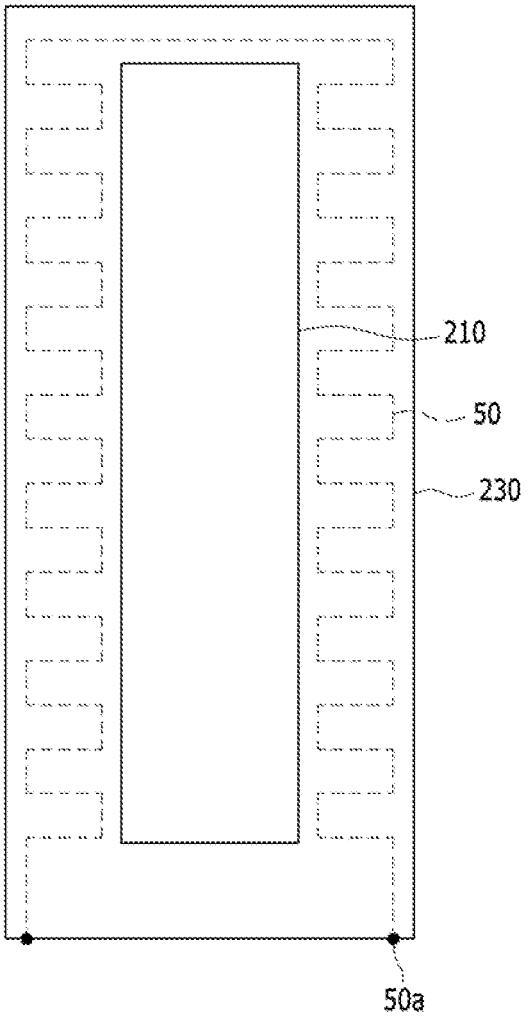

[Fig. 4]
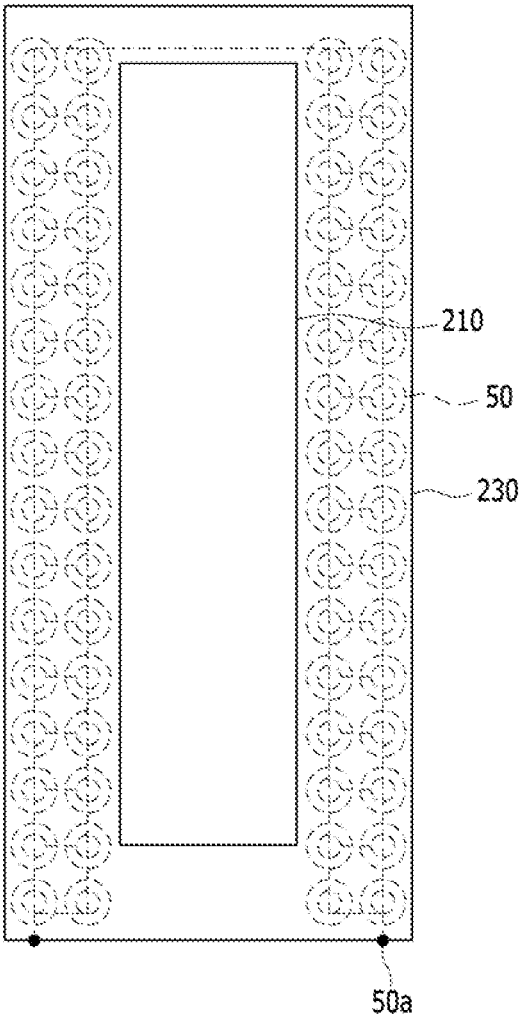

[Fig. 5]
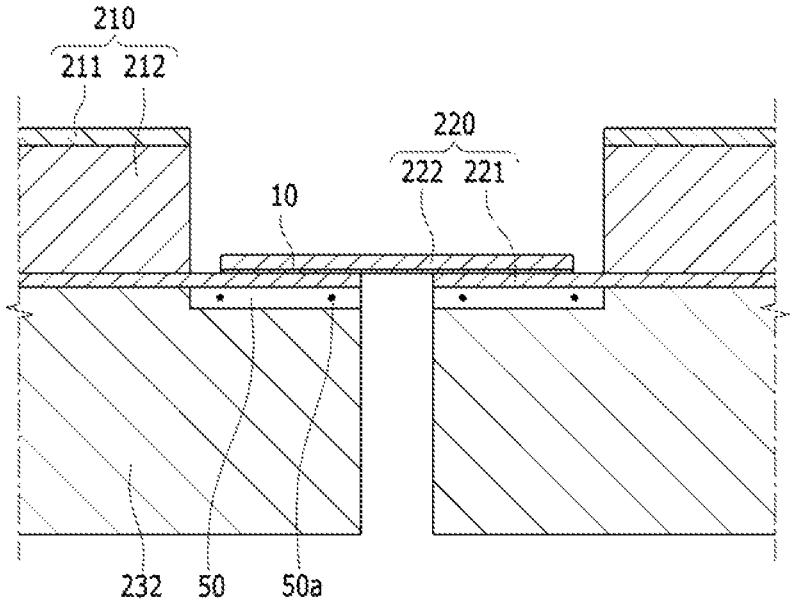

[Fig. 6]
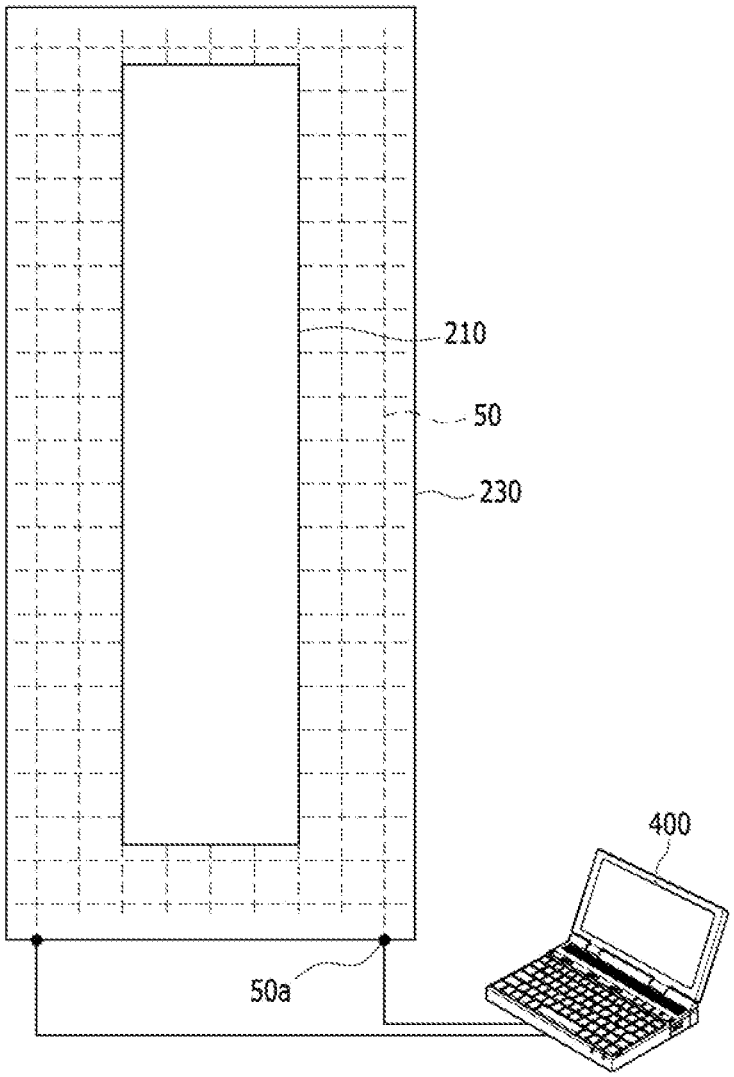

[Fig. 7]
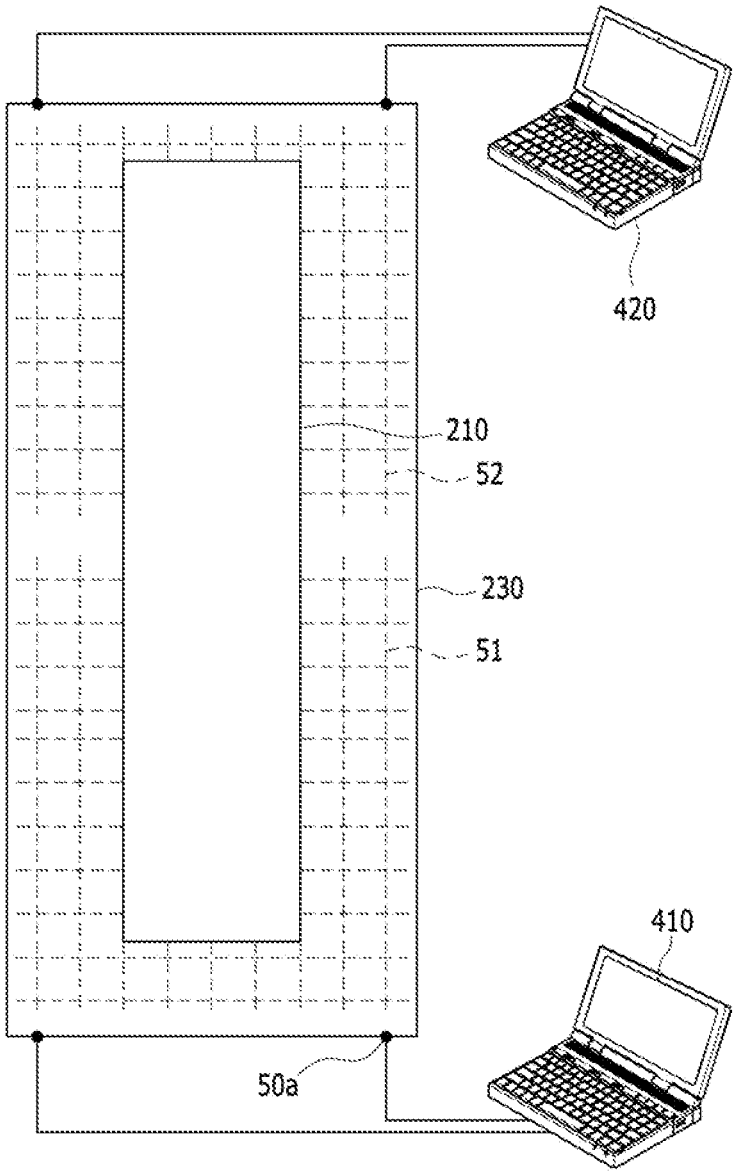

[Fig. 8]
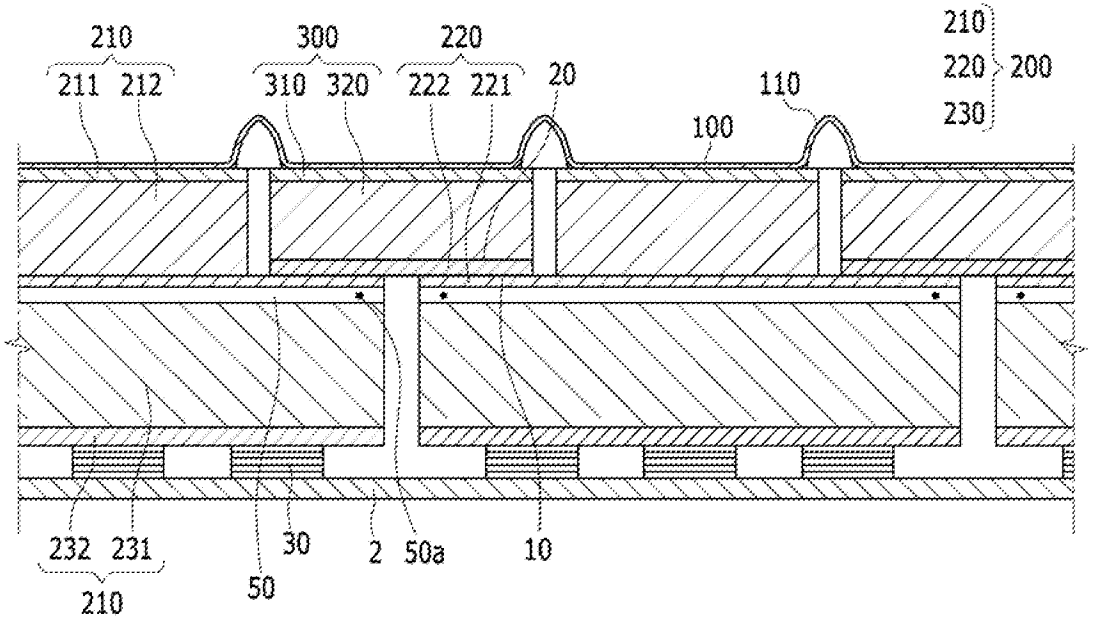

[Fig. 9]
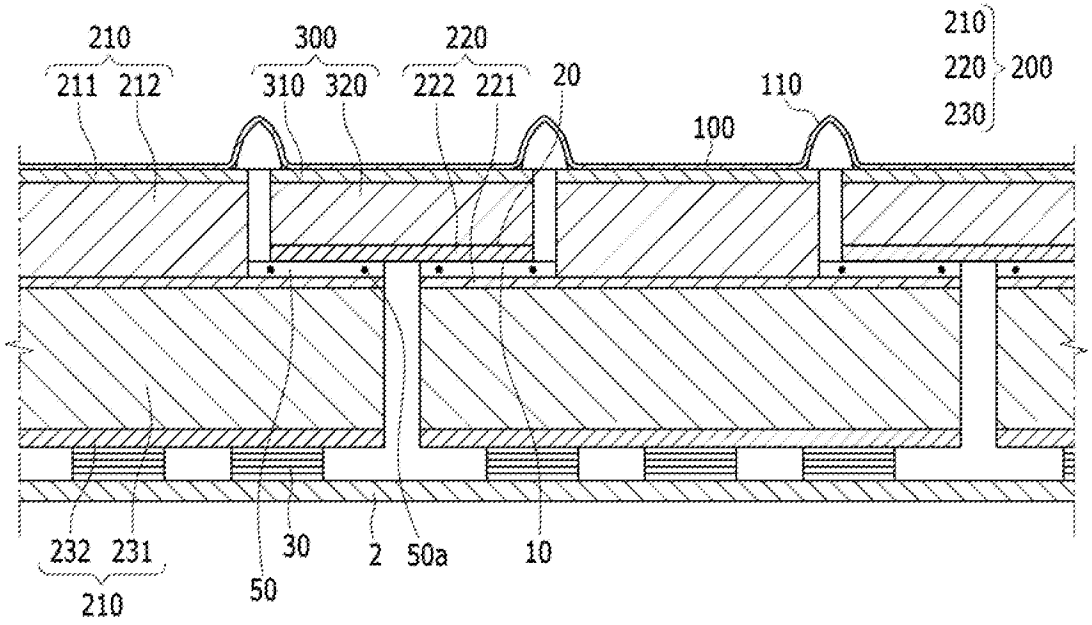

[Fig. 10]
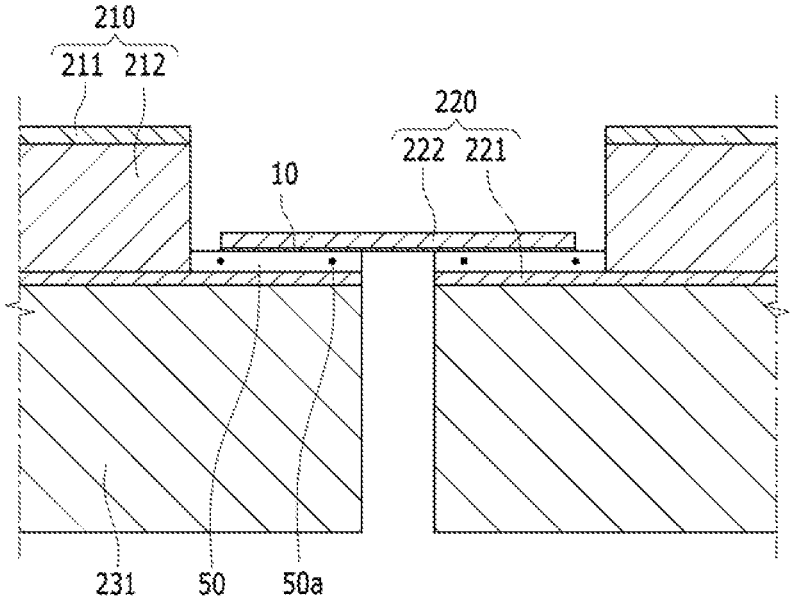

[Fig. 11]
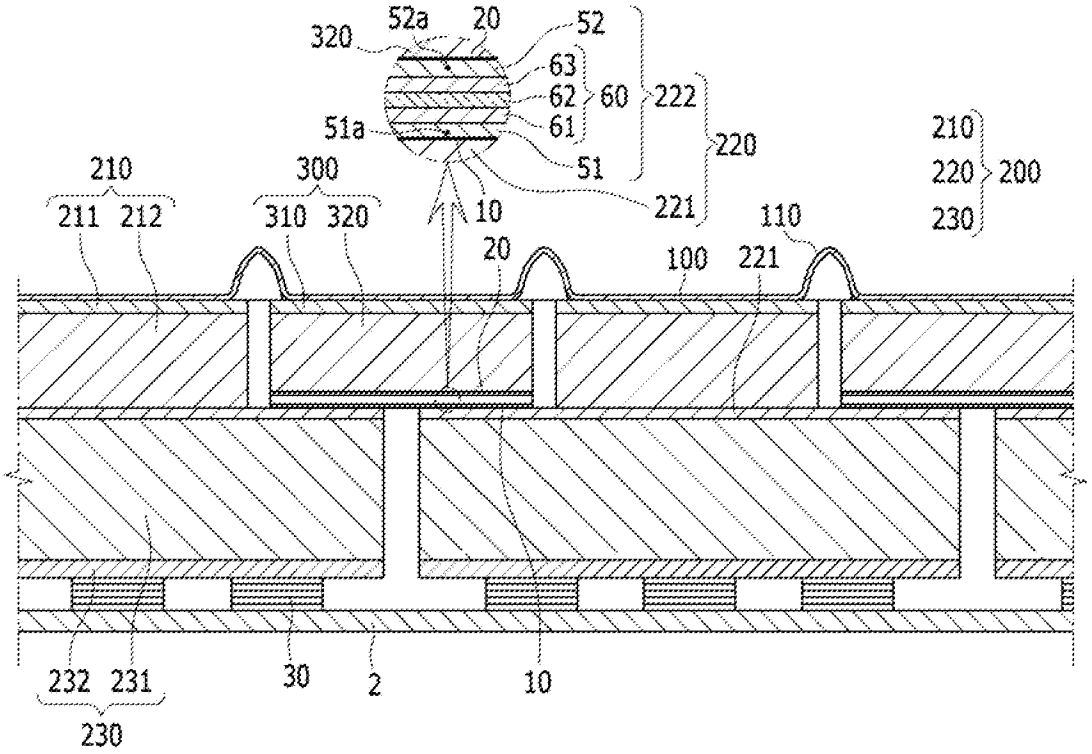

[Fig. 12]
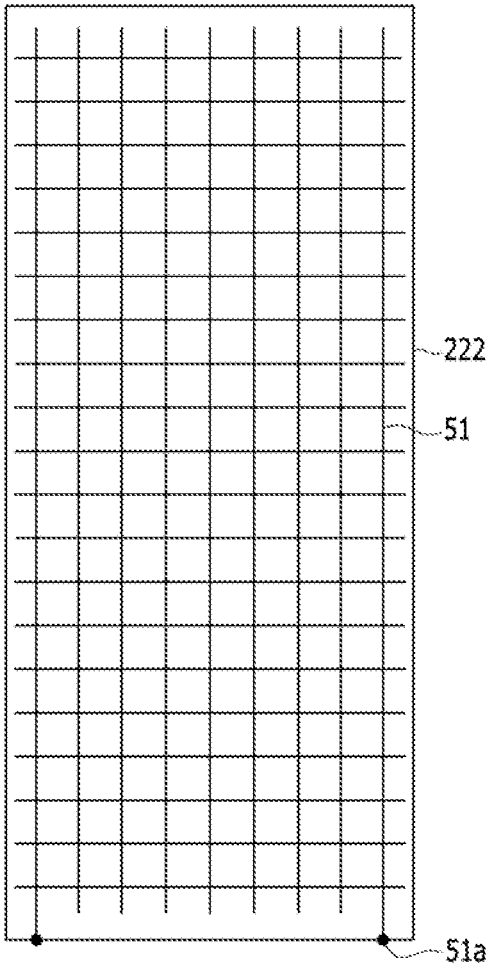
[Fig. 13]
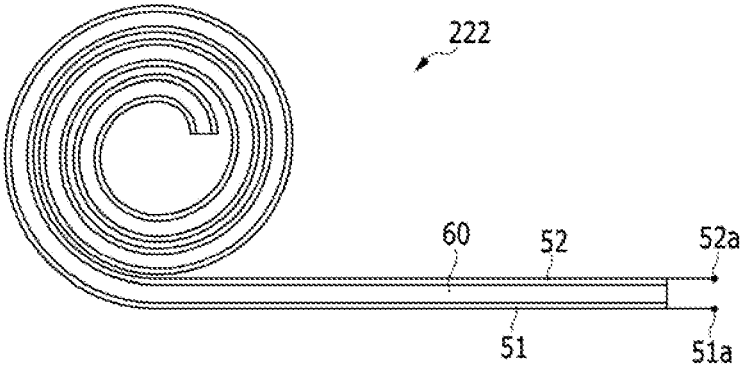

[Fig. 14]
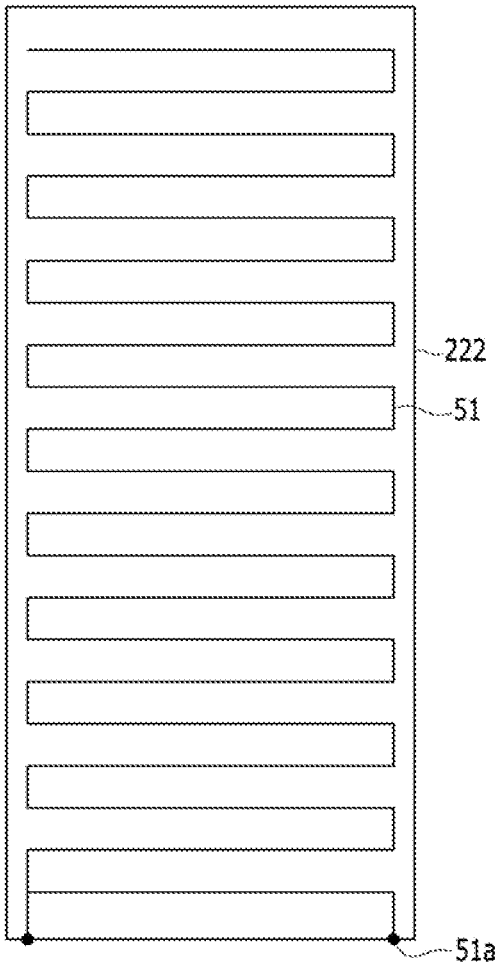

[Fig. 15]
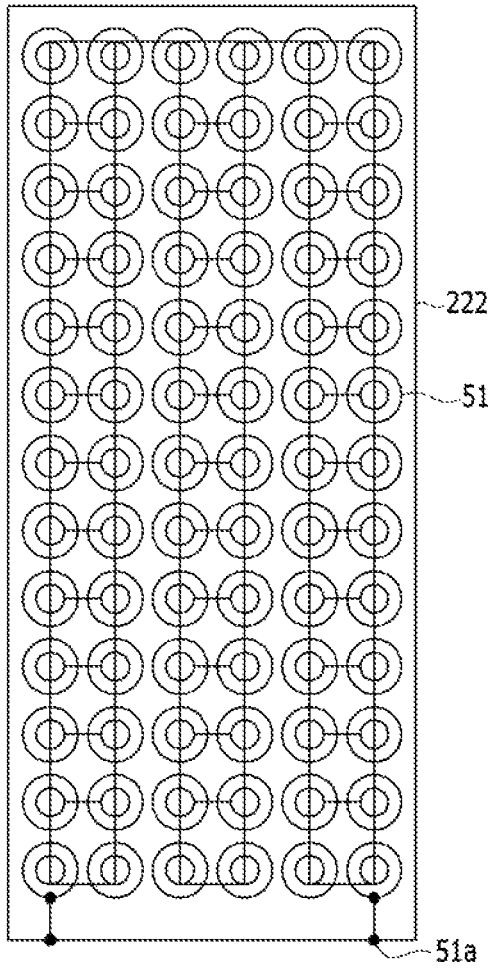

[Fig. 16]
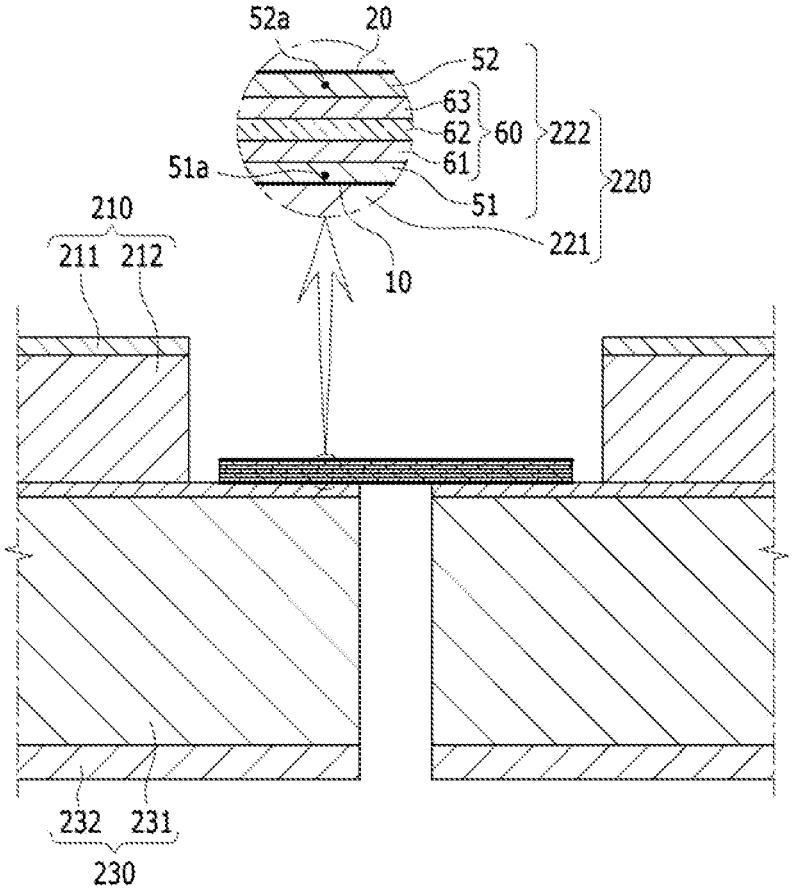

[Fig. 17]
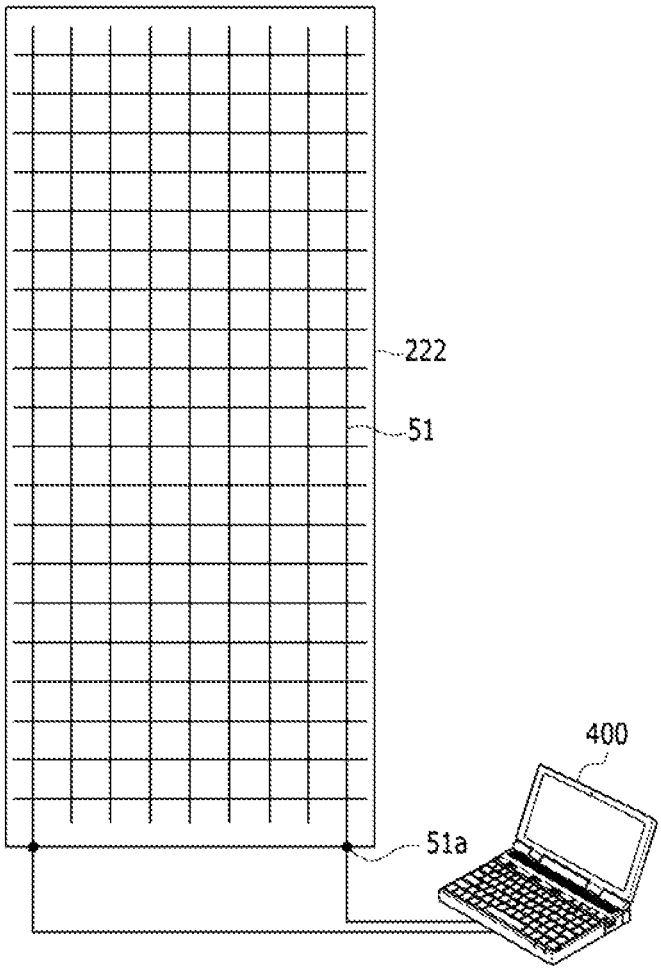

[Fig. 18]
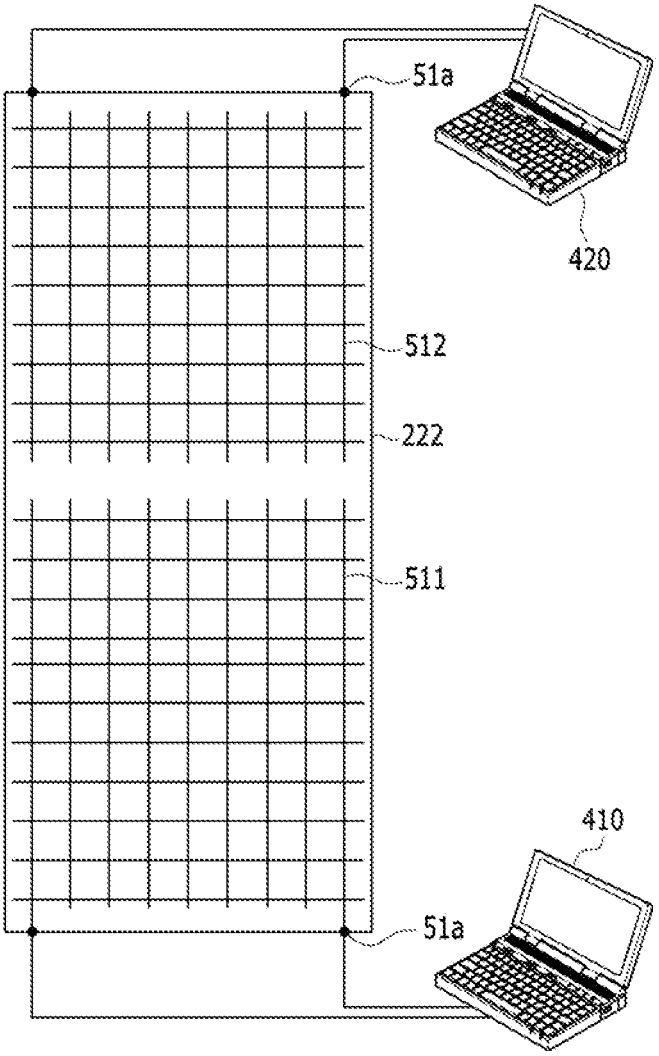

[Fig. 19]
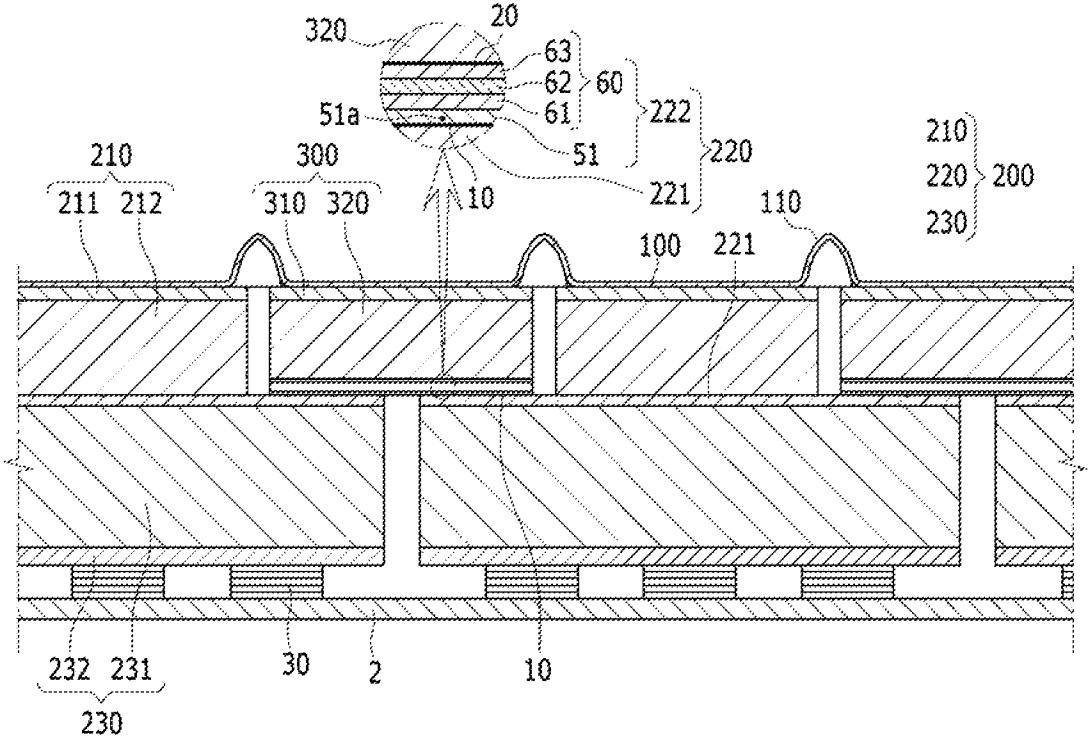

AUXILIARY SECONDARY BARRIER, LIQUEFIED NATURAL GAS STORAGE TANK INCLUDING SAME AND METHOD FOR MANUFACTURING THE LIQUEFIED NATURAL GAS STORAGE TANK

TECHNICAL FIELD

The present invention relates to an auxiliary secondary barrier, a liquefied natural gas storage tank including the same, and a method for manufacturing the same.

BACKGROUND ART

In general, liquefied natural gas (LNG) refers to a colorless, transparent, and ultra-low temperature liquid obtained by cooling methane-based natural gas at about −163° C. and reducing the volume thereof to 1/600.

The use of LNG as an energy resource has brought about the need for an efficient transportation means capable of carrying large amounts of LNG from a production base to a supply depot to use it as energy. LNG carriers capable of carrying large amounts of LNG by sea have been developed as part of this effort.

By the way, an LNG carrier has to be equipped with a LNG storage tank capable of containing cryogenically liquefied natural gas. The requirements for such an LNG storage tank are difficult to meet, causing many difficulties.

That is, since LNG has a vapor pressure that is higher than the atmospheric pressure and a boiling point of about 163° C., the LNG storage tank that stores LNG needs to be constructed with materials that can withstand very low temperature, for example, aluminum steel, stainless steel and 35% nickel steel, and designed in a unique insulation structure that can withstand thermal stress and thermal contraction and can be protected from heat leakage, in order to keep and store LNG safely.

A conventional LNG storage tank is constructed of a rectangular lower insulation board, a secondary barrier, and an upper insulation board sequentially laminated on the inner hull of an LNG carrier, with a primary barrier being attached on the upper insulation board.

Particularly, the secondary barrier includes a main secondary barrier located between the lower insulation board and the upper insulation board and an auxiliary secondary barrier that entirely covers neighboring two main secondary barriers, with a thermosetting adhesive layer being interposed between the main secondary barrier and the auxiliary secondary barrier to attach the auxiliary secondary barrier to the main secondary barrier.

However, when carrying out pressing and heating processes using an external heat source in order to apply heat to the thermosetting adhesive layer, it is difficult to uniformly heat a wide area and maintain pressure for long periods of time.

The above information disclosed in this Background section is only for enhancement of understanding of the background of the invention and therefore it may contain information that does not form the prior art that is already known in this country to a person of ordinary skill in the art.

DISCLOSURE

Technical Problem

The present invention has been made in an effort to provide an auxiliary secondary barrier which helps attach a secondary barrier uniformly and smoothly, a liquefied natural gas including the same, and a method for manufacturing the same.

Technical Solution

An exemplary embodiment of the present invention provides an LNG storage tank including: a lower insulation board for insulating LNG from the outside; a heating member placed on the lower insulation board; a main secondary barrier attached on the heating member; an upper insulation board attached on part of the main secondary barrier; and an auxiliary secondary barrier attached on the other part of the main secondary barrier, wherein a first adhesive layer may be interposed between the main secondary barrier and the auxiliary secondary barrier.

The heating member may be placed in the position where the auxiliary secondary barrier is attached.

The lower insulation board may have a heating member groove into which the heating member is inserted.

The heating member may be one selected from the group consisting of a net-like hot wire, a zigzag-shaped hot wire, or a plurality of circular hot wires connected together.

The heating member may have a connecting terminal that is to be connected to an external controller.

The heating member may include a plurality of sub-heating members that are to be respectively connected to a plurality of controllers.

The heating member may entirely cover the lower insulation board.

Another exemplary embodiment of the present invention provides a method for manufacturing an LNG storage tank, the method including: locating a heating member on a lower insulation board for insulating LNG from the outside; attaching a main secondary barrier on the heating member; forming a first adhesive layer over the main secondary barrier; and locating an auxiliary secondary barrier on the first adhesive layer over the main secondary barrier.

The method may further include heating the main secondary barrier using the heating member prior to the formation of the first adhesive layer.

The method may further include curing the first adhesive layer using the heating member to attach the main secondary barrier and the auxiliary secondary barrier together after the locating of the auxiliary secondary barrier on the first adhesive layer.

An external controller may control the heating member through a connecting terminal to cure the first adhesive layer.

The heating member may include a plurality of sub-heating members that are to be respectively connected to a plurality of controllers, and different temperatures may be applied to the plurality of sub-heating members.

Yet another exemplary embodiment of the present invention provides an LNG storage tank including: a lower insulation board for insulating LNG from the outside; a main secondary barrier attached on the lower insulation board; an upper insulation board attached on part of the main secondary barrier; a heating member placed on the main secondary barrier; and an auxiliary secondary barrier attached on the heating member, wherein a first adhesive layer may be interposed between the heating member and the auxiliary secondary barrier.

The heating member may be placed in the position where the auxiliary secondary barrier is attached.

The heating member may be one selected from the group consisting of a net-like hot wire, a zigzag-shaped hot wire, and a rotary-type hot wire connected together.

The heating member may have a connecting terminal that is to be connected to an external controller.

The heating member may include a plurality of sub-heating members that are to be respectively connected to a plurality of controllers.

A further exemplary embodiment of the present invention provides a method for manufacturing an LNG storage tank, the method including: attaching a main secondary barrier on a lower insulation board for insulating LNG from the outside; locating a heating member on the main secondary barrier; forming a first adhesive layer over the heating member; and locating an auxiliary secondary barrier on the first adhesive layer over neighboring two heating members.

The method may further include heating the main secondary barrier using the heating member prior to the formation of the first adhesive layer.

The method may further include curing the first adhesive layer using the heating member to attach the main secondary barrier and the auxiliary secondary barrier together after the locating of the auxiliary secondary barrier on the first adhesive layer.

An external controller may control the heating member through a connecting terminal to cure the first adhesive layer.

The heating member may include a plurality of sub-heating members that are to be respectively connected to a plurality of controllers, and different temperatures may be applied to the plurality of sub-heating members.

A further exemplary embodiment of the present invention provides an auxiliary secondary barrier which is attached on a main secondary barrier using a first adhesive layer, the main secondary barrier covering a lower insulation board for insulating LNG from the outside, the auxiliary secondary barrier including: a first heating member; a first metal foil layer formed over the first heating member; a glass fiber layer formed over the first metal foil layer; and a second metal foil layer formed over the glass fiber layer, wherein the first heating member may cure the first adhesive layer adjacent to the first metal foil layer.

The auxiliary secondary barrier may further include a second heating member placed over the second metal foil layer.

The first heating member and the second heating member may be ones selected from the group consisting of a net-like hot wire, a zigzag-shaped hot wire, or a plurality of circular hot wires connected together.

The first heating member and the second heating member may have a connecting terminal that is to be connected to an external controller.

The first heating member and the second heating member may include a plurality of first and second sub-heating members that are to be respectively connected to a plurality of controllers.

A further exemplary embodiment of the present invention provides an LNG storage tank including: a lower insulation board for insulating LNG from the outside; a main secondary barrier attached on the lower insulation board; an upper insulation board attached on part of the main secondary barrier; an auxiliary secondary barrier attached on neighboring portions of the main secondary barrier; and a first adhesive layer interposed between the main secondary barrier and the auxiliary secondary barrier, the auxiliary secondary barrier including: a first heating member; and a barrier sheet formed over the first heating member, wherein the first heating member may cure the first adhesive layer.

The LNG storage tank may further include a second heating member placed on the barrier sheet.

The barrier sheet may include: a first metal foil layer formed over the first heating member; a glass fiber layer formed over the first metal foil layer; and a second metal foil layer formed over the glass fiber layer.

The LNG storage tank may further include a second heating member attached on the second metal foil layer.

The first heating member and the second heating member may be ones selected from the group consisting of a net-like hot wire, a zigzag-shaped hot wire, or a plurality of circular hot wires connected together.

The first heating member and the second heating member may have a connecting terminal that is to be connected to an external controller.

The first heating member and the second heating member may include a plurality of first and second sub-heating members that are to be respectively connected to a plurality of controllers.

A further exemplary embodiment of the present invention provides a method for manufacturing an LNG storage tank, the method including: attaching a main secondary barrier on a lower insulation board for insulating LNG from the outside; attaching an upper insulation board on part of the main secondary barrier; forming a first adhesive layer on the main secondary barrier; preparing an auxiliary secondary barrier including a first heating member for curing the first adhesive layer and a barrier sheet formed over the first heating member; and locating an auxiliary secondary barrier on the first adhesive layer over neighboring portions of the main secondary barrier.

The method may further include heating the auxiliary secondary barrier using the first heating member prior to the formation of the first adhesive layer.

The method may further include curing the first adhesive layer using the first heating member to attach the main secondary barrier and the auxiliary secondary barrier together after the locating of the auxiliary secondary barrier on the first adhesive layer.

An external controller may control the first heating member through a connecting terminal to cure the first adhesive layer.

The first heating member may include a plurality of first sub-heating members that are to be respectively connected to a plurality of controllers, and different temperatures may be applied to the plurality of first sub-heating members.

The barrier sheet may include: a first metal foil layer formed over the first heating member; a glass fiber layer formed over the first metal foil layer; and a second metal foil layer formed over the glass fiber layer, wherein a second heating member may be attached on the second metal foil layer.

Advantageous Effects

According to an embodiment of the present invention, the secondary barrier can be easily attached to the insulation board, without an external heat source, by adhering the main secondary barrier and the auxiliary secondary barrier using the heating member installed on the lower insulation board.

Moreover, since the heating member is a net-like hot wire placed in all the parts where the auxiliary secondary barrier is attached, it supplies heat uniformly to all surfaces of the secondary barrier and uniformly cures the first adhesive layer, thereby improving adhesion.

According to an embodiment of the present invention, the auxiliary secondary barrier can be easily attached to the main secondary barrier, without an external heat source, by adhering the main secondary barrier and the auxiliary secondary barrier using the first heating member installed on the auxiliary secondary barrier.

Moreover, since the first heating member is a net-like hot wire placed in all the parts where the auxiliary secondary barrier is attached, it supplies heat uniformly to all surfaces of the auxiliary secondary barrier and uniformly cures the first adhesive layer, thereby improving adhesion between the auxiliary secondary barrier and the main secondary barrier.

DESCRIPTION OF THE DRAWINGS

FIG. 1 is a cross-sectional view of an LNG storage tank according to a first exemplary embodiment of the present invention.

FIG. 2 is a top plan view of an insulation board of the LNG storage tank according to the first exemplary embodiment of the present invention.

FIG. 3 is a top plan view of an insulation board with a zigzag-shaped heating member in the LNG storage tank according to the first exemplary embodiment of the present invention.

FIG. 4 is a top plan view of an insulation board with a rotary-type heating member in the LNG storage tank according to the first exemplary embodiment of the present invention.

FIG. 5 is a cross-sectional view illustrating an auxiliary secondary barrier being attached to a main secondary barrier, in the LNG storage tank according to the first exemplary embodiment of the present invention.

FIG. 6 is a view illustrating a connecting terminal of a heating member being connected to a controller, in the LNG storage tank according to the first exemplary embodiment of the present invention.

FIG. 7 is a top plan view of an insulation board in an LNG storage tank according to a second exemplary embodiment of the present invention.

FIG. 8 is a top plan view of an LNG storage tank according to a third exemplary embodiment of the present invention.

FIG. 9 is a top plan view of an LNG storage tank according to a fourth exemplary embodiment of the present invention.

FIG. 10 is a cross-sectional view illustrating an auxiliary secondary barrier being attached to a main secondary barrier, in the LNG storage tank according to the fourth exemplary embodiment of the present invention.

FIG. 11 is a cross-sectional view of an LNG storage tank according to a fifth exemplary embodiment of the present invention.

FIG. 12 is a top plan view of an auxiliary secondary barrier of the LNG storage tank according to the fifth exemplary embodiment of the present invention.

FIG. 13 is a view illustrating the rolled-up form of the auxiliary secondary barrier of the LNG storage tank according to the fifth exemplary embodiment of the present invention.

FIG. 14 is a top plan view of an auxiliary secondary barrier with a zigzag-shaped first heating member in the LNG storage tank according to the fifth exemplary embodiment of the present invention.

FIG. 15 is a top plan view of an auxiliary secondary barrier with a plurality of circular first heating members connected together in the LNG storage tank according to the fifth exemplary embodiment of the present invention.

FIG. 16 is a cross-sectional view illustrating an auxiliary secondary barrier being attached to a main secondary barrier, in the LNG storage tank according to the fifth exemplary embodiment of the present invention.

FIG. 17 is a view illustrating a connecting terminal of a first heating member of the auxiliary secondary barrier being connected to a controller, in the LNG storage tank according to the fifth exemplary embodiment of the present invention.

FIG. 18 is a top plan view of an auxiliary secondary barrier in an LNG storage tank according to a sixth exemplary embodiment of the present invention.

FIG. 19 is a top plan view of an LNG storage tank according to a seventh exemplary embodiment of the present invention.

<Description of Reference Numerals Indicating Primary Elements in the Drawings>

| | |
|---|---|
| 2: inner hull | 10: first adhesive layer |
| 20: second adhesive layer | 50: heating member |
| 50a: connecting terminal | 51: first heating member |
| 51a: connecting terminal | 52: second heating member |
| 100: primary barrier | 200: insulation board |
| 210: upper insulation board | 220: secondary barrier |
| 221: main secondary barrier | 222: auxiliary secondary barrier |
| 230: lower insulation board | 300: connecting board |
| 400: controller | |

MODE FOR INVENTION

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

FIG. 1 is a cross-sectional view of an LNG storage tank according to a first exemplary embodiment of the present invention. FIG. 2 is a top plan view of an insulation board of the LNG storage tank according to the first exemplary embodiment of the present invention.

As shown in FIG. 1 and FIG. 2, the LNG storage tank according to the first exemplary embodiment of the present invention includes a primary barrier 100 installed inside an inner hull 2 of an LNG carrier and coming into contact with LNG and an insulation board 200 installed on the underside of the primary barrier 100 and insulating the LNG from the outside.

The primary barrier 100 has a plurality of corrugations 110 that can contact and expand due to thermal deformation. The primary barrier 100 is in direct contact with cryogenic LNG with its temperature of −163° C., and thus is made of metallic materials, such as aluminum alloy, Invar, 9% nickel steel, etc, which are strong against brittleness at a low temperature and can address changes in stress. The plurality of corrugations 110, with their center being bulged, are formed all over the primary barrier 100, in order to allow easier expansion and contraction in response to repeated changes in temperature and changes in the weight of the stored liquid. The LNG storage tank may have a plural of the primary barrier 100

Neighboring two primary barriers 100 of a plurality of the primary barrier 100 may be welded along their edges and bonded together.

The insulation board 200 includes an upper insulation board 210, a secondary barrier 220 located on the underside of the upper insulation board 210 and preventing leakage of LNG, and a lower insulation board 230 located on the underside of the secondary barrier 220.

The upper insulation board 210 includes an upper insulation member protective plate 211 and an upper insulation member 212 attached on the underside of the upper insulation member protective plate 211. The upper insulation member protective plate 211 can be made of wood material such as plywood. The upper insulation member 212 can be made of an insulating material having heat insulating properties, for example, polyurethane foam.

The secondary barrier 220 includes a main secondary barrier 221 located between the upper insulation board 210 and the lower insulation board 230 and an auxiliary secondary barrier 222 that entirely covers neighboring two main secondary barriers 221.

A first adhesive layer 10 is formed between the main secondary barrier 221 and the auxiliary secondary barrier 222 to bond them together. The first adhesive layer 10 is a thermosetting adhesive layer, and can include at least one of epoxy resin, polyurethane resin, phenolic resin, and polyester resin. Further, the first adhesive layer 10 can include B-stage pre-preg or a thermosetting thin film adhesive. The first adhesive layer 10 is melted into a liquid form when heat energy is applied to it at a temperature of 80 to 200° C., and then solidified by crosslinking, making the main secondary barrier 221 and the auxiliary secondary barrier 222 bonded together.

The secondary barrier 220 can consist of a plate-like member made of at least one of metal and non-metal materials, which is a lamination of thin plates formed of at least one of a plurality of metal and non-metal materials. For example, the secondary barrier 220 can be formed by laminating a 0.25 mm-thickness glass fiber composite between two aluminum foils with a thickness of 70 μm.

A connecting board 300 connecting neighboring two insulation boards 200 is located on the auxiliary secondary barrier 222 between neighboring two upper insulation boards 210. The connecting board 300 includes a connecting member protective plate 310 and a connecting member 320 attached to the underside of the connecting member protective plate 310. The connecting member protective plate 310 may be made of wood material such as plywood. The connecting member 320 can be made of an insulating material having heat insulating properties, for example, polyurethane foam.

A second adhesive layer 20 is formed between the auxiliary secondary barrier 222 and the connecting member 320, and the second adhesive layer 20 can include at least one of epoxy resin, polyurethane resin, phenolic resin, and polyester resin. Further, the second adhesive layer 20 can include B-stage pre-preg or a thermosetting thin film adhesive. The second adhesive layer 20 is melted into a liquid form when heat energy is applied to it at a temperature of 80 to 200° C., and then solidified by crosslinking, making the auxiliary secondary barrier 222 and the connecting member 320 bonded together.

The lower insulation board 230 includes a lower insulation member 231 and a lower insulation member protective plate 232 attached to the underside of the lower insulation member 231. The lower insulation member 231 can be made of an insulating material having heat insulating properties, for example, polyurethane foam.

A heating member groove 231*a* is formed in the surface of the lower insulation board 230 facing the main secondary barrier 221, and a heating member 50 for applying heat to the first adhesive layer 10 and curing the first adhesive layer 10 is installed in the heating member groove 231*a*. The heating member 50 is placed in the part which is not covered by the upper insulation board 210 and where the auxiliary secondary barrier 222 is attached. In the drawing, the depth of the heating member 231*a* is exaggerated to clearly show the heating member 50.

The heating member 50 may be a net-like hot wire, and the heating member 50 has a connecting terminal 50*a* that is to be connected to an external controller.

The secondary barrier 220 can be easily attached to the insulation board 200, without an external heat source, by adhering the main secondary barrier 221 and the auxiliary secondary barrier 222 using the heating member 50 installed on the lower insulation board 230. Moreover, since the heating member 50 is a net-like hot wire placed in all the parts where the auxiliary secondary barrier 222 is attached, it supplies heat uniformly to all surfaces of the secondary barrier 220 and uniformly cures the first adhesive layer 10, thereby improving adhesion.

The heating member 50 of this type can have various shapes, which will be described in detail with reference to FIGS. 3 and 4.

FIG. 3 is a top plan view of an insulation board with a zigzag-shaped heating member in the LNG storage tank according to the first exemplary embodiment of the present invention. FIG. 4 is a top plan view of an insulation board with a rotary-type heating member in the LNG storage tank according to the first exemplary embodiment of the present invention.

As shown in FIG. 3, the heating member 50 may be a zigzag-shaped hot wire, and the heating member 50 is placed in the part which is not covered by the upper insulation board 210 and where the auxiliary secondary barrier 222 is attached.

As shown in FIG. 4, the heating member 50 may be a plurality of circular hot wires connected together, and the heating member 50 is placed in the part which is not covered by the upper insulation board 210 and where the auxiliary secondary barrier 222 is attached.

Moreover, since the heating member 50 is formed of a zigzag-shaped hot wire or a plurality of circular hot wires connected together, it supplies heat uniformly to the part where the auxiliary secondary barrier 222 is attached, thereby improving adhesion.

The lower insulation member protective plate 232 can be made of wood material such as plywood and attached to the inner hull 22 by a plurality of adhesive members. The adhesive members 30 can include epoxy resin. The lower insulation board 230 can be fixed to the inner hull 22 by a fixing means.

A method for manufacturing an LNG storage tank according to the first exemplary embodiment of the present invention will be described below with reference to FIGS. 5 and 6.

FIG. 5 is a cross-sectional view illustrating an auxiliary secondary barrier being attached to a main secondary barrier, in the LNG storage tank according to the first exemplary embodiment of the present invention. FIG. 6 is a view illustrating a connecting terminal of a heating member being connected to a controller, in the LNG storage tank according to the first exemplary embodiment of the present invention.

First of all, as shown in FIG. 5, in the method for manufacturing an LNG storage tank according to the first exemplary embodiment of the present invention, the heating member 50 is located on the lower insulation board 230. A heating member groove 231*a* is formed in the surface of the lower insulation board 230 facing the main secondary barrier 221 in the part where the auxiliary secondary barrier 222 is adhered, and the heating member 50 is located in the heating member groove 231*a*.

The main secondary barrier 221 is attached on the lower insulation board 230 and the heating member 50. The upper insulation board 210 is attached on the main secondary barrier 221 in the part where the heating member 50 is not attached. A first adhesive layer 10 is formed over the main secondary barrier 221 in the area where the heating member 50 is located. The auxiliary secondary barrier 222 is located on the first adhesive layer 10 over neighboring two main secondary barriers 221, and the auxiliary secondary barrier 222 is pressed firmly against the main secondary barrier 221. Alternatively, the first adhesive layer 10 may be formed on the underside of the auxiliary secondary barrier 222, and the auxiliary 222 may be adhered to the main secondary barrier 221. Although FIG. 5 illustrates the first adhesive layer 10 formed entirely on the underside of the auxiliary secondary barrier 222, the first adhesive layer 10 may be formed only in the part adhered to the main secondary barrier 221.

Next, as shown in FIG. 6, an external controller 400 can control the heating member 50 through the connecting terminal 50*a* of the heating member 50 to cure the first adhesive layer 10 and attach the main secondary barrier 221 and the auxiliary secondary barrier 222 together. One or more connecting terminals 50*a* may be placed, and the connecting terminals 50*a* may be placed adjacent to each other or spaced apart from each other depending on the shape of the heating member 50.

In the foregoing description, the main secondary barrier 221 and the auxiliary secondary barrier 222 are attached together by locating the auxiliary secondary barrier 222 on the first adhesive layer 10, pressing it, and then curing the first adhesive layer 10 using the heating member 50; otherwise, the main secondary barrier 221 and the auxiliary secondary barrier 222 may be attached together by heating the main secondary barrier 221 using the heating member 50 prior to the formation of the first adhesive layer 10, forming the first adhesive layer 10 over the main secondary barrier 221 in the area where the heating member 50 is located, and pressing the auxiliary secondary barrier 222.

While the first exemplary embodiment illustrates only one heating member placed on the lower insulation board, a plurality of sub-heating members separate from each other may be placed on it according to a second exemplary embodiment of the present invention.

An LNG storage tank according to a second exemplary embodiment of the present invention will be described below in detail with reference to FIG. 7.

FIG. 7 is a top plan view of an insulation board in an LNG storage tank according to a second exemplary embodiment of the present invention.

The second exemplary embodiment is substantially identical to the first exemplary embodiment illustrated in FIGS. 1 and 2, except that a plurality of sub-heating members separate from each other are placed, so redundant descriptions will be omitted.

As shown in FIG. 7, a first sub-heating member 51 and a second sub-heating member 52, separate from each other, are installed on the lower insulation board 230 of the LNG storage tank according to the second exemplary embodiment of the present invention. The first sub-heating member 51 and the second sub-heating member 52 are placed in the part which is not covered by the upper insulation board 210 and where the auxiliary secondary barrier 222 is attached.

The first sub-heating member 51 and the second sub-heating member 52 may be net-like hot wires, and the first sub-heating member 51 and the second sub-heating member 52 each have a plurality of connecting terminals 50*a* that are to be connected to an external first controller 410 and an external second controller 420, respectively.

The first controller 410 and the second controller 420 may be used to apply different temperatures to the first sub-heating member 51 and the second sub-heating member 52, depending on where the first sub-heating member 51 and the second sub-heating member 52 are placed, what the placement of them looks like, and the amount of application of the first adhesive layer 10. Alternatively, either the first sub-heating member 51 or the second sub-heating member 52 may be heated, or the first sub-heating member 51 may be heated first and the second sub-heating member 52 may be then heated.

While the heating members are placed only in the position where the auxiliary secondary barrier is attached in the first exemplary embodiment, the heating members may be placed while covering the lower insulation board entirely according to a third exemplary embodiment.

An LNG storage tank according to a third exemplary embodiment of the present invention will be described below in detail with reference to FIG. 8.

FIG. 8 is a top plan view of an LNG storage tank according to a third exemplary embodiment of the present invention.

The third exemplary embodiment is substantially identical to the first exemplary embodiment illustrated in FIGS. 1 and 2, except for the position where a heating member is placed, so redundant descriptions will be omitted.

As shown in FIG. 8, a heating member 50 for applying heat to the first adhesive layer 10 and curing the first adhesive layer 10 is installed on all surfaces of the lower insulation board 230 of the LNG storage tank according to the third exemplary embodiment of the present invention. The heating member 50 is placed under the upper insulation board 210 and in the position where the auxiliary secondary barrier 222 is attached.

The heating member 50 may be a net-like hot wire, and the heating member 50 of this type has a connecting terminal 50*a* which is to be connected to an external controller.

The heating member 50 is placed so as to cover all surfaces of the lower insulation board 230 so that it can also be placed under the upper insulation board 210, thereby adhering the main secondary barrier 221 and the auxiliary secondary barrier 222 more firmly.

While the heating member is placed between the lower insulation board and the main secondary barrier in the third exemplary embodiment, the heating member may be placed on the main secondary barrier according to a fourth exemplary embodiment.

An LNG storage tank according to a fourth exemplary embodiment of the present invention will be described below in detail with reference to FIG. 9.

FIG. 9 is a top plan view of an LNG storage tank according to a fourth exemplary embodiment of the present invention.

The fourth exemplary embodiment is substantially identical to the first exemplary embodiment illustrated in FIGS. 1 and 2, except for the position where a heating member is placed, so redundant descriptions will be omitted.

As shown in FIG. 9, an insulation board 200 of the LNG storage tank according to the fourth exemplary embodiment of the present invention includes an upper insulation board 210, a secondary barrier 220 located on the underside of the upper insulation board 210 and preventing leakage of LNG, and a lower insulation board 230 located on the underside of the secondary barrier 220.

The secondary barrier 220 includes a main secondary barrier 221 located between the upper insulation board 210 and the lower insulation board 230 and an auxiliary secondary barrier 222 that entirely covers neighboring portions of the main secondary barrier 221.

A heating member 50 is installed on the part of the main secondary barrier 221 that does not overlap with the upper insulation board 210. That is, the heating member 50 is placed in the position where the auxiliary secondary barrier 222 is attached, in between the main secondary barrier 221 and the auxiliary secondary barrier 222.

The heating member 50 may be a net-like hot wire, and the heating member 50 of this type has a connecting terminal 50*a* which is to be connected to an external controller. The first adhesive layer 10 is formed over the heating member 50, and the first adhesive layer 10 is cured to attach the main secondary barrier 221 and the auxiliary secondary barrier 222 together.

The secondary barrier 220 can be easily attached to the insulation board 200, without an external heat source, by curing the first adhesive layer 10 applied between the heating member 50 and the auxiliary secondary barrier 222 using the heating member 50 installed between the main secondary barrier 221 and the auxiliary secondary barrier 222 and adhering the main secondary barrier 221 and the auxiliary secondary barrier 222 together. Moreover, since the heating member 50 is a net-like hot wire placed in all the parts where the auxiliary secondary barrier 222 is attached, it supplies heat uniformly to all surfaces of the secondary barrier 220 and uniformly cures the first adhesive layer 10, thereby improving adhesion.

A method for manufacturing an LNG storage tank according to the fourth exemplary embodiment of the present invention will be described below with reference to FIGS. 6 and 10.

FIG. 10 is a cross-sectional view illustrating an auxiliary secondary barrier being attached to a main secondary barrier, in the LNG storage tank according to the fourth exemplary embodiment of the present invention.

First of all, as shown in FIG. 10, in the method for manufacturing an LNG storage tank according to the fourth exemplary embodiment of the present invention, the main secondary barrier 221 is attached on the lower insulation board 230. The upper insulation board 210 is attached on the main secondary barrier 221, and the heating member 50 is located on the main secondary barrier 221 in the part where the upper insulation board 210 is not attached.

A first adhesive layer 10 is formed over the heating member 50. The auxiliary secondary barrier 222 is located on the first adhesive layer 10 over neighboring two main secondary barriers 221, and the auxiliary secondary barrier 222 is pressed firmly against the main secondary barrier 221.

Next, as shown in FIG. 6, an external controller 400 can control the heating member 50 through the connecting terminal 50*a* of the heating member 50 to cure the first adhesive layer 10 and attach the main secondary barrier 221 and the auxiliary secondary barrier 222 together. One or more connecting terminals 50*a* may be placed, and the connecting terminals 50*a* may be placed adjacent to each other or spaced apart from each other depending on the shape of the heating member 50.

In the foregoing description, the main secondary barrier 221 and the auxiliary secondary barrier 222 are attached together by locating the auxiliary secondary barrier 222 on the first adhesive layer 10, pressing it, and then curing the first adhesive layer 10 using the heating member 50; otherwise, the main secondary barrier 221 and the auxiliary secondary barrier 222 may be attached together by heating the main secondary barrier 221 using the heating member 50 prior to the formation of the first adhesive layer 10, forming the first adhesive layer 10 over the main secondary barrier 221 in the area where the heating member 50 is located, and pressing the auxiliary secondary barrier 222.

While the first exemplary embodiment illustrates the main secondary barrier and the auxiliary secondary barrier being adhered together using the heating member installed on the lower insulation board, the main secondary barrier and the auxiliary secondary barrier may be attached together using a first heating member installed on the auxiliary secondary barrier according to a fifth exemplary embodiment of the present invention.

An LNG storage tank according to a fifth exemplary embodiment of the present invention will be described below in detail with reference to FIGS. 11 to 13.

FIG. 11 is a cross-sectional view of an LNG storage tank according to a fifth exemplary embodiment of the present invention. FIG. 12 is a top plan view of an auxiliary secondary barrier of the LNG storage tank according to the fifth exemplary embodiment of the present invention. FIG. 13 is a view illustrating the rolled-up form of the auxiliary secondary barrier of the LNG storage tank according to the fifth exemplary embodiment of the present invention.

As shown in FIG. 11 and FIG. 12, the LNG storage tank according to the fifth exemplary embodiment of the present invention includes a primary barrier 100 installed inside the inner hull 2 of an LNG carrier and coming into contact with LNG and an insulation board 200 installed on the underside of the primary barrier 100 and insulating the LNG from the outside.

The primary barrier 100 has a plurality of corrugations 110 that can contact and expand due to thermal deformation. temperature of −163° C., and thus is made of metallic materials, such as aluminum alloy, Invar, 9% nickel steel, etc, which are strong against brittleness at a low temperature and can address changes in stress. The plurality of corrugations 110, with their center being bulged, are formed all over the primary barrier 100, in order to allow easier expansion and contraction in response to repeated changes in temperature and changes in the weight of the stored liquid. Neighboring two the primary barriers 100 may be welded along their edges and bonded together.

The insulation board 200 includes an upper insulation board 210, a secondary barrier 220 located on the underside of the upper insulation board 210 and preventing leakage of LNG, and a lower insulation board 230 located on the underside of the secondary barrier 220.

The upper insulation board 210 includes an upper insulation member protective plate 211 and an upper insulation member 212 attached on the underside of the upper insulation member protective plate 211. The upper insulation member protective plate 211 can be made of wood material such as plywood. The upper insulation member 212 can be made of an insulating material having heat insulating properties, for example, polyurethane foam.

The secondary barrier 220 includes a main secondary barrier 221 located between the upper insulation board 210 and the lower insulation board 230 and an auxiliary secondary barrier 222 that entirely covers neighboring two main secondary barriers 221.

A first adhesive layer 10 is formed between the main secondary barrier 221 and the auxiliary secondary barrier 222 to bond them together. The first adhesive layer 10 is a thermosetting adhesive layer, and can include at least one of epoxy resin, polyurethane resin, phenolic resin, and polyester resin. Further, the first adhesive layer 10 can include B-stage pre-preg or a thermosetting thin film adhesive. The first adhesive layer 10 is melted into a liquid form when heat energy is applied to it at a temperature of 80 to 200° C., and then solidified by crosslinking, making the main secondary barrier 221 and the auxiliary secondary barrier 222 bonded together.

The main secondary barrier 221 includes a first metal foil layer 61 coming into contact with the lower insulation board 230, a glass fiber layer 62 formed over the first metal foil layer 61, and a second metal foil layer 62 formed over the glass fiber layer 62.

The auxiliary secondary barrier 222 includes a first heating member 51 coming into contact with the first adhesive layer 10, a barrier sheet 60 formed over the first heating member 51, and a second heating member 52 attached on the barrier sheet 60. The barrier sheet 60 includes a first metal foil layer 61 formed over the first heating member 51, a glass fiber layer 62 formed over the first metal foil layer 61, and a second metal foil layer 63 formed over the glass fiber layer 62.

The first metal foil layer 61 and the second metal foil layer 63 can be made of aluminum or stainless steel, and the glass fiber layer 62 can be made of pre-preg, a fiber-reinforced composite material.

As shown in FIG. 2, the first heating member 51 is installed to entirely cover all surfaces of the auxiliary secondary barrier 222, and applies heat to the first adhesive layer 10 to cure the first adhesive layer 10.

The first heating member 51 may be a net-like hot wire, and the first heating member 51 has a connecting terminal 51*a* that is to be connected to an external controller 400.

The auxiliary secondary barrier 222 can be easily attached to the main secondary barrier 221, without an external heat source, by adhering the main secondary barrier 221 and the auxiliary secondary barrier 222 using the first heating member 51 installed on the auxiliary secondary barrier 222. Moreover, since the first heating member 51 is a net-like hot wire placed in all the parts where the auxiliary secondary barrier 222 is attached, it supplies heat uniformly to all surfaces of the auxiliary secondary barrier 222 and uniformly cures the first adhesive layer 10, thereby improving adhesion between the auxiliary secondary barrier 222 and the main secondary barrier 221.

As shown in FIG. 13, the auxiliary secondary barrier 222 of the LNG storage tank according to the fifth exemplary embodiment of the present invention may come in a rolled-up form. Accordingly, necessary parts may be cut out and consecutively and smoothly put into the manufacturing process of the LNG storage tank.

The heating member 51 of this type can have various shapes, which will be described in detail with reference to FIGS. 14 and 15.

FIG. 14 is a top plan view of an auxiliary secondary barrier with a zigzag-shaped first heating member in the LNG storage tank according to the fifth exemplary embodiment of the present invention. FIG. 15 is a top plan view of an auxiliary secondary barrier with a plurality of first circular heating members connected together in the LNG storage tank according to the fifth exemplary embodiment of the present invention.

As shown in FIG. 14, the first heating member 51 may be a zigzag-shaped hot wire, and the first heating member 51 covers all parts of the auxiliary secondary barrier 222 and has a connecting terminal 51*a* that is to be connected to the external controller 400.

As shown in FIG. 15, the first heating member 51 may be a plurality of circular hot wires connected together, and the first heating member 51 covers all parts of the auxiliary secondary barrier 222 and has a connecting terminal 51*a* that is to be connected to the external controller 400.

By manufacturing the auxiliary secondary barrier 222 having the first heating member 51 consisting of a zigzag-shaped hot wire or a plurality of circular hot wires connected together, heat can be uniformly supplied to the part where the auxiliary secondary barrier 222 is attached, thereby improving adhesion.

Referring back to FIG. 11, a connecting board 300 connecting neighboring two insulation boards 200 is located on the auxiliary secondary barrier 222 between neighboring two upper insulation boards 210. The connecting board 300 includes a connecting member protective plate 310 and a connecting member 320 attached to the underside of the connecting member protective plate 310. The connecting member protective plate 310 may be made of wood material such as plywood. The connecting member 320 can be made of an insulating material having heat insulating properties, for example, polyurethane foam.

A second adhesive layer 20 is formed between the auxiliary secondary barrier 222 and the connecting member 320, and the second adhesive layer 20 can include at least one of epoxy resin, polyurethane resin, phenolic resin, and polyester resin. Further, the second adhesive layer 20 can include B-stage pre-preg or a thermosetting thin film adhesive. The second adhesive layer 20 is melted into a liquid form when heat energy is applied to it at a temperature of 80 to 200° C., and then solidified by crosslinking, making the auxiliary secondary barrier 222 and the connecting member 320 bonded together.

The second heating member 52 is installed to entirely cover all surfaces of the auxiliary secondary barrier 222, and applies heat to the second adhesive layer 20 to cure the second adhesive layer 20. The second heating member 52 may be a net-like hot wire, and the second heating member 52 has a connecting terminal 52*a* that is to be connected to an external controller 400.

The auxiliary secondary barrier 222 can be easily attached to the connecting member 320, without an external heat source, by adhering the auxiliary secondary barrier 222 and the connecting member 320 using the second heating member 52 installed on the auxiliary secondary barrier 222. Moreover, since the second heating member 52 is a net-like hot wire placed in all the parts where the auxiliary secondary barrier 222 is attached, it supplies heat uniformly to all surfaces of the auxiliary secondary barrier 222 and uniformly cures the second adhesive layer 20, thereby improving adhesion between the auxiliary secondary barrier 222 and the connecting member 320.

The lower insulation board 230 includes a lower insulation member 231 and a lower insulation member protective plate 232 attached on the underside of the lower insulation member 231. The lower insulation member 231 can be made of an insulating material having heat insulating properties, for example, polyurethane foam.

The lower insulation member protective plate 232 can be made of wood material such as plywood and attached on the inner hull 22 by a plurality of adhesion members 30, and the adhesion members 40 can include epoxy resin. The lower insulation board 230 can be fixed to the inner hull 2 by a fixing means.

A method for manufacturing an LNG storage tank according to the fifth exemplary embodiment of the present invention will be described below in detail with reference to FIG. 16 and FIG. 17.

FIG. 16 is a cross-sectional view illustrating an auxiliary secondary barrier being attached to a main secondary barrier, in the LNG storage tank according to the fifth exemplary embodiment of the present invention. FIG. 17 is a view illustrating a connecting terminal of a first heating member of the auxiliary secondary barrier being connected to a controller, in the LNG storage tank according to the fifth exemplary embodiment of the present invention.

First of all, as shown in FIG. 16, in the method for manufacturing an LNG storage tank according to the fifth exemplary embodiment of the present invention, the main secondary barrier 221 is attached on the lower insulation board 230. The upper insulation board 210 is attached on part of the main secondary barrier 221. The first adhesive layer 10 is formed over the main secondary barrier 221 in the area where the upper insulation board 210 is not attached. Next, the auxiliary secondary barrier 222 including the first heating member 51, the barrier sheet 60 formed over the first heating member 51, and the second heating member 52 attached on the barrier sheet 60 is prepared. Then, the auxiliary secondary barrier 222 is located on the first adhesive layer 10 over neighboring two main secondary barriers 221, and the auxiliary secondary barrier 222 is pressed firmly against the main secondary barrier 221. Alternatively, the first adhesive layer 10 may be formed on the underside of the auxiliary secondary barrier 222, and the auxiliary 222 may be adhered to the main secondary barrier 221. Although FIG. 16 illustrates the first adhesive layer 10 formed entirely on the underside of the auxiliary secondary barrier 222, the first adhesive layer 10 may be formed only in the part adhered to the main secondary barrier 221.

Next, as shown in FIG. 17, an external controller 400 can control the first heating member 51 through the connecting terminal 51*a* of the first heating member 51 to cure the first adhesive layer 10 and attach the main secondary barrier 221 and the auxiliary secondary barrier 222 together. One or more connecting terminals 51*a* may be placed, and the connecting terminals 51*a* may be placed adjacent to each other or spaced apart from each other depending on the shape of the first heating member 51.

In the foregoing description, the main secondary barrier 221 and the auxiliary secondary barrier 222 are attached together by locating the auxiliary secondary barrier 222 on the first adhesive layer 10, pressing it, and then curing the first adhesive layer 10 using the first heating member 51; otherwise, the main secondary barrier 221 and the auxiliary secondary barrier 222 may be attached together by heating the auxiliary secondary barrier 221 using the first heating member 51 prior to the formation of the first adhesive layer 10, forming the first adhesive layer 10 over the main secondary barrier 221, and pressing the auxiliary secondary barrier 222.

While the fifth exemplary embodiment illustrates only one heating member placed on one surface of the auxiliary secondary barrier, a plurality of first sub-heating members separate from each other may be placed on it according to a sixth exemplary embodiment of the present invention.

An LNG storage tank according to a sixth exemplary embodiment of the present invention will be described below in detail with reference to FIG. 18.

FIG. 18 is a top plan view of an auxiliary secondary barrier in an LNG storage tank according to a sixth exemplary embodiment of the present invention.

The sixth exemplary embodiment is substantially identical to the fifth exemplary embodiment illustrated in FIGS. 11 and 12, except that a plurality of first sub-heating members separate from each other are placed, so redundant descriptions will be omitted.

As shown in FIG. 8, a first sub-heating member 511 and a second sub-heating member 512, separate from each other, are installed on the auxiliary secondary barrier 222 of the LNG storage tank according to the sixth exemplary embodiment of the present invention. The first sub-heating member 511 and the second sub-heating member 512 cover all parts of the auxiliary secondary barrier 222.

The first sub-heating member 511 and the second sub-heating member 512 may be net-like hot wires, and the first sub-heating member 511 and the second sub-heating member 512 each have a plurality of connecting terminals 51*a* that are to be connected to an external first controller 410 and an external second controller 420, respectively.

The first controller 410 and the second controller 420 may be used to apply different temperatures to the first sub-heating member 511 and the second sub-heating member 512, depending on where the first sub-heating member 511 and the second sub-heating member 512 are placed, what the placement of them looks like, and the amount of application of the first adhesive layer 10. Alternatively, either the first sub-heating member 511 or the second sub-heating member 512 may be heated, or the first sub-heating member 511 may be heated first and the second sub-heating member 512 may be then heated.

While the first heating member and the second heating member are placed under and over the barrier sheet in the fifth exemplary embodiment, the first heating member may be placed only under the barrier sheet according to a seventh exemplary embodiment.

An LNG storage tank according to a seventh exemplary embodiment of the present invention will be described below in detail with reference to FIG. 19.

FIG. 19 is a top plan view of an LNG storage tank according to a seventh exemplary embodiment of the present invention.

The seventh exemplary embodiment is substantially identical to the fifth exemplary embodiment illustrated in FIGS. 11 and 12, except for the absence of the second heating member, so redundant descriptions will be omitted.

As shown in FIG. 19, the auxiliary secondary barrier 222 of the LNG storage tank according to the seventh exemplary embodiment of the present invention includes a first heating member 51 coming into contact with the first adhesive layer 10 and a barrier sheet 60 formed over the first heating member 51. The barrier sheet 60 includes a first metal foil layer 61 formed over the first heating member 51, a glass fiber layer 62 formed over the first metal foil layer 61, and a second metal foil layer 63 formed over the glass fiber layer 62.

The first heating member 51 is installed to entirely cover all surfaces of the auxiliary secondary barrier 222, and applies heat to the first adhesive layer 10 to cure the first adhesive layer 10. The first heating member 51 may be a net-like hot wire, and the first heating member 51 has a connecting terminal 51*a* that is to be connected to an external controller 400.

The auxiliary secondary barrier 222 can be easily attached to the main secondary barrier 221, without an external heat source, by adhering the main secondary barrier 221 and the auxiliary secondary barrier 222 using the first heating member 51 installed on the auxiliary secondary barrier 222. Moreover, since the first heating member 51 is a net-like hot wire placed in all the parts where the auxiliary secondary barrier 222 is attached, it supplies heat uniformly to all surfaces of the auxiliary secondary barrier 222 and uniformly cures the first adhesive layer 10, thereby improving adhesion between the auxiliary secondary barrier 222 and the main secondary barrier 221.

Au auxiliary secondary barrier, an LNG storage tank including the same, and a method for manufacturing the same according to an exemplary embodiment of the present invention are applicable to LNG storage tanks, such as LNG FPSOs (floating production, storage and offloading) or LNG FSRUs (Floating Storage and Regasification Units), installed in floating structures, as well as LNG storage tanks installed in self-navigable LNG carriers or LNG RVs (Regasification Vessels).

The present invention has been described as above with reference to the exemplary embodiments illustrated in the drawings. However, the present invention is not limited to these exemplary embodiments and one skilled in the art can make various modifications or other embodiments without departing from the scope of the present invention and its equivalents. Therefore, the true protective range of the present invention should be determined by the claims that follow.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

The invention claimed is:

1. An LNG storage tank comprising:

a lower insulation board for insulating LNG from the outside;

a heating member placed on the lower insulation board;

a main secondary barrier attached on the heating member;

an upper insulation board attached on part of the main secondary barrier;

an auxiliary secondary barrier attached on the other part of the main secondary barrier; and a connecting board disposed on the auxiliary secondary barrier and disposed between the upper insulation boards adjacent to each other, wherein a first adhesive layer is interposed between the main secondary barrier and the auxiliary secondary barrier, and the heating member is disposed between the lower insulation board and the main secondary barrier, and wherein the main secondary barrier extends between the lower insulation board and the upper insulation board, and the heating member, the main secondary barrier, the auxiliary secondary barrier, and the connecting board overlap each other.

2. The LNG storage tank of claim 1, wherein the heating member is placed in the position where the auxiliary secondary barrier is attached, and wherein the lower insulation board has a heating member groove into which the heating member is inserted.

3. The LNG storage tank of claim 1, wherein the heating member is one selected from the group consisting of a net-like hot wire, a zigzag-shaped hot wire, or a plurality of circular hot wires connected together.

4. The LNG storage tank of claim 1, wherein the heating member has a connecting terminal that is to be connected to an external controller.

5. The LNG storage tank of claim 4, wherein the heating member comprises a plurality of sub-heating members that are to be respectively connected to a plurality of controllers.

6. The LNG storage tank of claim 1, wherein the heating member entirely covers the lower insulation board.

7. A method for manufacturing an LNG storage tank, the method comprising:

locating a heating member on a lower insulation board for insulating LNG from the outside;

attaching a main secondary barrier on the heating member;

forming a first adhesive layer over the main secondary barrier;

locating an auxiliary secondary barrier on the first adhesive layer over the main secondary barrier;

attaching an upper insulation board on the main secondary barrier; and locating a connecting board on the auxiliary secondary barrier, wherein the heating member is disposed between the lower insulation board and the main secondary barrier, and wherein the main secondary barrier extends between the lower insulation board and the upper insulation board, and the heating member, the main secondary barrier, the auxiliary secondary barrier, and the connecting board overlap each other.

8. The method of claim 7, further comprising heating the main secondary barrier using the heating member prior to the formation of the first adhesive layer.

9. The method of claim 7, further comprising curing the first adhesive layer using the heating member to attach the main secondary barrier and the auxiliary secondary barrier together after the locating of the auxiliary secondary barrier on the first adhesive layer.

* * * * *